US009556602B2

(12) United States Patent
Claunch et al.

(10) Patent No.: US 9,556,602 B2
(45) Date of Patent: Jan. 31, 2017

(54) SELF-CONTAINED OIL FLUSH TOILET UNIT AND SEWAGE TREATMENT SYSTEM FOR SEPARATING AND PRE-TREATING WASTE

(71) Applicants: Robert Claunch, Slidell, LA (US); John Worth Claunch, Slidell, LA (US)

(72) Inventors: Robert Claunch, Slidell, LA (US); John Worth Claunch, Slidell, LA (US)

( * ) Notice: Subject to any disclaimer, the term of this patent is extended or adjusted under 35 U.S.C. 154(b) by 0 days.

(21) Appl. No.: 13/861,747

(22) Filed: Apr. 12, 2013

(65) Prior Publication Data

US 2014/0304904 A1 Oct. 16, 2014

(51) Int. Cl.
*E03D 11/00* (2006.01)
*E03D 5/016* (2006.01)

(52) U.S. Cl.
CPC ..... *E03D 5/016* (2013.01)

(58) Field of Classification Search
CPC ..... E03D 5/016
USPC ..... 4/432, 408, DIG. 10–DIG. 12, 318
See application file for complete search history.

(56) References Cited

U.S. PATENT DOCUMENTS

| | | | | |
|---|---|---|---|---|
| 3,673,614 | A | 7/1972 | Claunch | |
| 3,974,528 | A * | 8/1976 | Claunch et al. | 210/167.3 |
| 4,040,956 | A * | 8/1977 | Selwitz | 210/764 |
| 4,222,130 | A * | 9/1980 | Roberts | 4/321 |
| 4,313,233 | A * | 2/1982 | Roberts | 4/321 |
| 4,519,103 | A * | 5/1985 | De Graw et al. | 4/317 |
| 6,004,463 | A | 12/1999 | Swett | |
| 6,412,121 | B2 | 7/2002 | Motoyama | |
| 6,442,768 | B1 | 9/2002 | Hammond | |
| 6,487,731 | B1 | 12/2002 | Houde | |
| 6,519,787 | B2 | 2/2003 | Kim | |
| 6,581,336 | B2 * | 6/2003 | Anttalainen et al. | 52/34 |
| 6,767,464 | B2 | 7/2004 | Boyd et al. | |
| 7,005,077 | B1 | 2/2006 | Brenner et al. | |
| 7,211,187 | B2 | 5/2007 | Lumbert | |
| 8,167,587 | B2 * | 5/2012 | Dorsey et al. | 417/400 |
| 8,533,873 | B2 * | 9/2013 | West, Jr. | 4/111.4 |

OTHER PUBLICATIONS theconstructonline.com Dec. 23, 2012.*

* cited by examiner

*Primary Examiner* — Christine Skubinna
(74) *Attorney, Agent, or Firm* — Global Intellectual Property Agency, LLC

(57) ABSTRACT

A self-contained, oil flush medium toilet system is provided having a largely rectangular enclosure that separates the flush medium from collected waste and preprocesses the waste for subsequent removal. The device requires no connection to sewage or water lines, and can be installed with only electrical connections for continual operation. Waste is first received through a toilet bowl, whereafter it is consumed by the oil and falls under the surface thereof. The waste is then circulated below the oil, whereby it is continually aerated to promote aerobic digestion of the waste until it reaches a certain volume, where the processed waste exits the enclosure for further processing or storage. The oil flush medium is pumped through a particulate and carbon filter to maintain its condition, wherein the oil is immiscible with the waste to first consume it and remain above the waste within the enclosure during operation.

16 Claims, 7 Drawing Sheets

SELF-CONTAINED OIL FLUSH TOILET UNIT AND SEWAGE TREATMENT SYSTEM FOR SEPARATING AND PRE-TREATING WASTE

BACKGROUND OF THE INVENTION

Field of the Invention

The present invention pertains to an oil flush toilet system that can operate independently from existing waste treatment infrastructure. More specifically, the present invention comprises a self-contained, environmentally friendly, and efficient oil flush toilet enclosed within a stand-alone unit that does not require any external sewage connections in order to operate and treat waste. Waste is collected in a commode style structure, treated, and then removed periodically while the treated byproducts are exhausted. The unit requires only an electrical connection and periodic maintenance for sustained operation.

Most indoor toilets are permanent fixtures connected through a plumbing network to a wastewater treatment system managed by a local municipality. Sewage from the residential or commercial buildings transfers from the toilet and into sewage pipes that route the wastewater for external treatment at a dedicated facility. This modern system has proven to be an effective solution for managing large quantities of wastewater in a developed area, but its operation has some inherent drawbacks.

The first of these is the limitation that conventional toilets must be connected to an existing sewage system. This requires infrastructure dedicated to the collection and treatment of wastewater. In certain rural and developing parts of the world, the necessary infrastructure for permanent, indoor plumbing is lacking. This creates potential problems for the local population as there is no system to remove waste from the local area. Untreated waste near living areas creates a public health hazard for the populous and an environmental concern for the local habitat.

Another drawback to conventional flush toilets relates to plumbing systems in high rise buildings and the necessary energy required to operate these systems. Conventional toilets utilize a considerable amount of water to remove waste from the building. For high rise buildings, the water is pumped to the higher floors for circulation of the water and subsequent removal of the waste. The energy required to pump the water up many stories can quickly become significant and require several pumps in order to operate successfully. Operation of this type of system in extremely tall buildings comes at a great expense in terms of energy and in terms wasted water, which is inefficient for the building owner and inefficient in terms of energy consumption.

Yet another drawback to most conventional toilet systems is their excessive water consumption. In conventional sewage treatment systems, the flush or transport medium is water, which represents 90 to 98 percent of the total volume of the sewage being handled. This consumption of fresh water is wasteful of natural resource, where fresh water has become ever more valuable in large regions of the world. The fresh water is used as both a transport medium and a means to block foul odors from exiting the toilet during use. However, the ever growing demands for fresh water makes this use less appealing, where the fresh water could otherwise be utilized for human consumption, agriculture, or for commercial applications.

Finally, most conventional toilet systems pose an inherent risk to the environment in terms of potential contamination of the local area with untreated or escaping wastewater. Even with existing infrastructure to treat mass volumes of sewage, the distance between waste collection areas and treatment centers introduces the risk of contamination into the local environment. Furthermore, if the wastewater is not subsequently treated correctly before being discharged into a local waterway, the waterway and surrounding environment will be adversely impacted. This can result in health risks and have an impact on the local environment.

The present invention pertains to a self-contained toilet system that utilizes a reusable oil flush medium. The unit is compact and requires no connection to an existing sewage line. Rather than using water as a medium to transport waste, a mineral oil is utilized, which can be readily separated from the sewage within the toilet unit and without external processing. When the terms "sewage" or "waste" are used herein they are meant to describe any of the typical forms of waste matter generally encountered in sewage handling systems, including human excreta, paper, cigarette butts and the like. The oil flush medium cleans the toilet bowl and carries the waste below the toilet and into a separate chamber, wherein it is aerobically biodegraded and the waste is liquefied for discharge to an evaporator or other disposal means.

Description of the Prior Art

Devices have been disclosed in the prior art that relate to toilet systems and means of processing wastewater. These include devices that have been patented and published in patent application publications, and generally relate to larger systems for processing waste or for oil flush toilets of diverging purpose. The following is a list of devices deemed most relevant to the present disclosure, which are herein described for the purposes of highlighting and differentiating the unique aspects of the present invention, and further highlighting the drawbacks existing in the prior art.

Systems with reusable media have been previously disclosed wherein the flush media is of a density different from that of the sewage. U.S. Pat. No. 3,673,614 to Robert W. Claunch and assigned to Chrysler Corporation, as well as and U.S. Pat. No. 3,974,528 to Robert W. Claunch and assigned to Chrysler Corporation describe systems that have been successfully developed and used in the field with success. The systems described in these patents eliminate the use of water as a flush as a flush medium for sewage waste and substitute a reusable medium. The reusable flush medium is substantially immiscible with water and of a sufficient difference in density from that of water and other sewage waste to permit physical separation of the sewage from the flush medium. The medium is also chemically stable under the operating conditions of the sewage facility and in the presence of sewage waste.

In these systems, the flush medium is supplied to a point of use, such as an ordinary toilet commode or urinal, and then flushed with any waste received through a sewer line into a separation tank. In the separating tank, because of its difference in density, the flush medium rises above the waste to float on it and an interface forms between the point of contact between the medium and the sewage waste. Liquid flush medium floating on the waste in the separation tank is preferably passed through a suitable filter means and into a fluid circulation system for reuse. The circulation system preferably includes a pressurized storage tank or accumulator equipped with a pressure switch means which automatically activates a pump in the circulation system when the pressure in the accumulator drops below a preset minimum. The waste collects at the bottom of the separating tank until a sufficient quantity has accumulated to activate an automatic transfer means. Waste is then transferred from the separating tank into a waste receiving means, such as a catch tank, holding tank, incinerator, aerobic digester or the like. After a given quantity of the waste has been transferred the transfer means automatically stops and the accumulation of waste in the lower part of the separation tank starts again. The transfer means prevents carryover of sewage waste with the flush medium when it is removed from the separating tank An electrical control system including floats and switches is used in the patented system to activate the transfer means at appropriate times for controlling the volume of waste and flush medium retained in the separating tank. The '528 patent improved the original '614 device by eliminating the need for a grinder waste pump with level sensors and switches. This new embodiment provided for automatic discharge of partially digested liquefied waste to a remote holding tank or treatment means.

The present invention provides a new oil-flush toilet system that is provided within a self-contained unit, wherein the waste is collected and preconditioning for transfer to an external disposal means, wherein the collection and preconditioning takes place in a one container. The toilet bowl, the toilet seat, the flush fluid pump, the waste conditioning means, and all functions of the previous inventions will take place in one container, except for the flush fluid filters and electrical switches. The same method of waste water separation from flush fluid is utilized within a confined unit; however no external sewer lines or flush fluid provider lines need be connected outside of the container. This arrangement allows for the placement of a toilet inside an existing building without having to provide collection lines for the toilet waste, while flush fluid is recycled and continuously replenished as it is consumed over several flushings and waste water extractions.

Other devices related to oil flush toilets and self-contained waste treatment toilets include U.S. Pat. No. 6,487,731 to Houde and U.S. Pat. No. 6,442,768 to Hammond. The Houde device describes an oil toilet wherein oil is utilized as a sealant to isolate unpleasant odors produced by waste materials in the toilet. A cleaning means comprising a stop valve and a discharge valve removes waste materials from the toilet while reusing a substantial amount of the oil in the toilet. The Hammond device describes a self-contained toilet that utilizes compressed air and a flush liquid to remove waste, whereby water is not consumed in the process. Within the toilet unit is a heater for dehydrating the waste and a grinder for grinding the waste into a powder, wherein the powdered waste is recovered by a receptacle for later disposal. While providing new and unique waste removal systems, the Houde and Hammond devices do not describe the functional elements of the present invention, which utilizes an oil flush system that separates and conditions waste for removal in a compact unit.

It is therefore submitted that the present invention is substantially divergent in design elements from the prior art, and consequently it is clear that there is a need in the art for an improvement to existing oil flush toilet devices. In this regard the instant invention substantially fulfills these needs.

SUMMARY OF THE INVENTION

In view of the foregoing disadvantages inherent in the known types of self-contained oil flush toilet systems now present in the prior art, the present invention provides a new oil flush toilet system that can be utilized for providing convenience for the user when deploying a self-contained toilet system in an area lacking adequate sewer lines for removal of the waste water, and further for providing a self-contained unit that pre-processes the waste water for subsequent removal over a maintenance interval.

It is therefore an object of the present invention to provide a new and improved self-contained oil flush toilet system that has all of the advantages of the prior art and none of the disadvantages.

It is a primary objective of the present invention to provide a practical apparatus and system for flush medium collection, wherein the system achieves substantially complete separation of the flush medium from the sewage wastewater by a simple and inexpensive process that requires only electric power and no external sewage lines.

It is another object of the present invention to provide a self-contained oil flush toilet system that utilizes mineral oil flush medium to provide a barrier between the user and waste, wherein the waste is forced below the oil surface layer for processing and subsequent removal. The processing comprises an aerobic system that biodegrades the waste underneath the oil surface.

Another object of the present invention is to provide a self-contained oil flush toilet system that utilizes the immiscibility of the waste water and the oil to force the waste water below the oil surface, wherein the waste is liquefied for later discharge to an external evaporator or external disposal means outside of the disclosed unit.

Yet another object of the present invention is to provide a self-contained oil flush toilet system that utilizes a thick layer of oil flush medium to trap waste therebelow and also trap associated odors of the waste below the oil surface, reducing the objectionable fumes from rising into the restroom.

Another object of the present invention is to provide a self-contained oil flush toilet system that includes a sighting window to observe the oil level within the unit and to determine if replenishment of oil is required.

Another object of the present invention is to provide a self-contained oil flush toilet system that includes an oil filter system to maintain the quality of the oil over a long period of time to remove fine particles, dissolved contaminants, surface active agents, color bodies and odor producing contaminants from the oil, allowing for extended use of a given quantity of oil within the unit.

Yet another object of the present invention is to provide a self-contained oil flush toilet system designed in such a manner that the interface between the oil flush medium and the waste in the unit is maintained at a substantially constant level without the use of mechanical or electrical controls.

This invention provides a practical and readily deployable system for collecting sewage while eliminating the use of water as a flush medium and substituting a reusable medium. To accomplish this objective, the flush medium selected must be substantially immiscible with water, of a sufficient difference in density from that of water and sewage to permit physical separation of the sewage from the flush medium and it must be chemically stable at the operating conditions of the sewage facility and in the presence of sewage.

To accomplish these and other objectives, the flush medium is recycled through a fluid circulation means to a point of use (i.e. a commode). The flush medium is then flushed with sewage into a separating tank, wherein the flush medium is separated from the sewage and returned to the fluid circulation means for reuse. The sewage, which in most cases will consist of human excreta and other normal commode or urinal deposits, is received in a standard toilet bowl from which it is flushed with the flush medium and into the separating tank where the sewage is transferred after separation from the flush medium to a point of ultimate sewage disposal outside of the disclosed toilet unit. This outside disposal may include a biological incinerator, aerobic digester, or even simply to a holding tank or other suitable sewage storage means.

More specifically, the preferred system transfers sewage to a combination sump and flush medium storage and separation tank wherein separation of the flush medium from the sewage takes place. Sewage carried by the flush medium enters the sump where the sewage, because of its difference in density, settles to the bottom of the sump while the flush medium rises above the sewage and is thereby separated therefrom. After the flush medium rises above the sewage, it is pumped through suitable filter means and into a fluid circulation system that will flow the cleaned flush medium over the toilet bowl surfaces and back into the sump.

In a simplified manner, the present invention prevents any significant loss of flush medium throughout the system. No flush medium is carried over with waste as it leaves the separating tank during waste removal from the system, as it is sufficiently separated and contained within a separate partition within the unit. The flush medium is also continually cleaned and recirculated to maintain its proper functionality and to maintain its immiscibility with the wastewater. Untreated oil flush fluid will eventually take on sufficient contaminates that mixing of the oil and wastewater would occur, therefore the oil is continually circulated and filtered for maintenance thereof. Therefore, the waste readily separates and settles to the base of the unit while the oil flush fluid rises to the top because of the differences in density of the flush fluid and the waste. After a period of biodegradation and repeated use, the wastewater can is removed through a rear port set at a level to automatically drain the wastewater into another receptacle or treatment process.

These and other objects are attained by providing a system in such a manner that the entire apparatus of collecting waste and preconditioning it for transfer to a disposal means takes place in a single container. The toilet bowl, seat, flush fluid pump, waste conditioning means, and all functions for processing and collecting the waste take place in one container, except for flush fluid filters and electrical switches. No sewer lines or flush fluid provider lines are required outside the one container.

The components not contained in the basic container include an external electrical power source, an air pump, flush fluid filters, an electrical switch box, and a container or discharge line to receive the preconditioned waste for subsequent processing or disposal. The preconditioned waste may be disposed of through an evaporator that can be located remotely or in the same room with the toilet or transferred to any final disposal system or to a temporary holding tank. A vent blower is used to remove gasses from the operation and to exhaust those gasses to the outside.

The use and maintenance of mineral oil as a flush fluid medium to dispose of toilet waste is essential. The separation of oil and water because of their immiscibility and the difference in specific gravity provides the basis for the system to operate and to preprocess the waste received therein. The waste separates from the flush fluid and settles to the base of the unit, wherein it flows between chambers and an air lift pump pulverizes the waste and adds air to the waste stream for aerobic digestion. The waste stream will flow in a circle returning constantly to the source of aeration and the airlift pump that causes the flow and pulverizes the waste for continual cycle beneath the oil.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 6A:
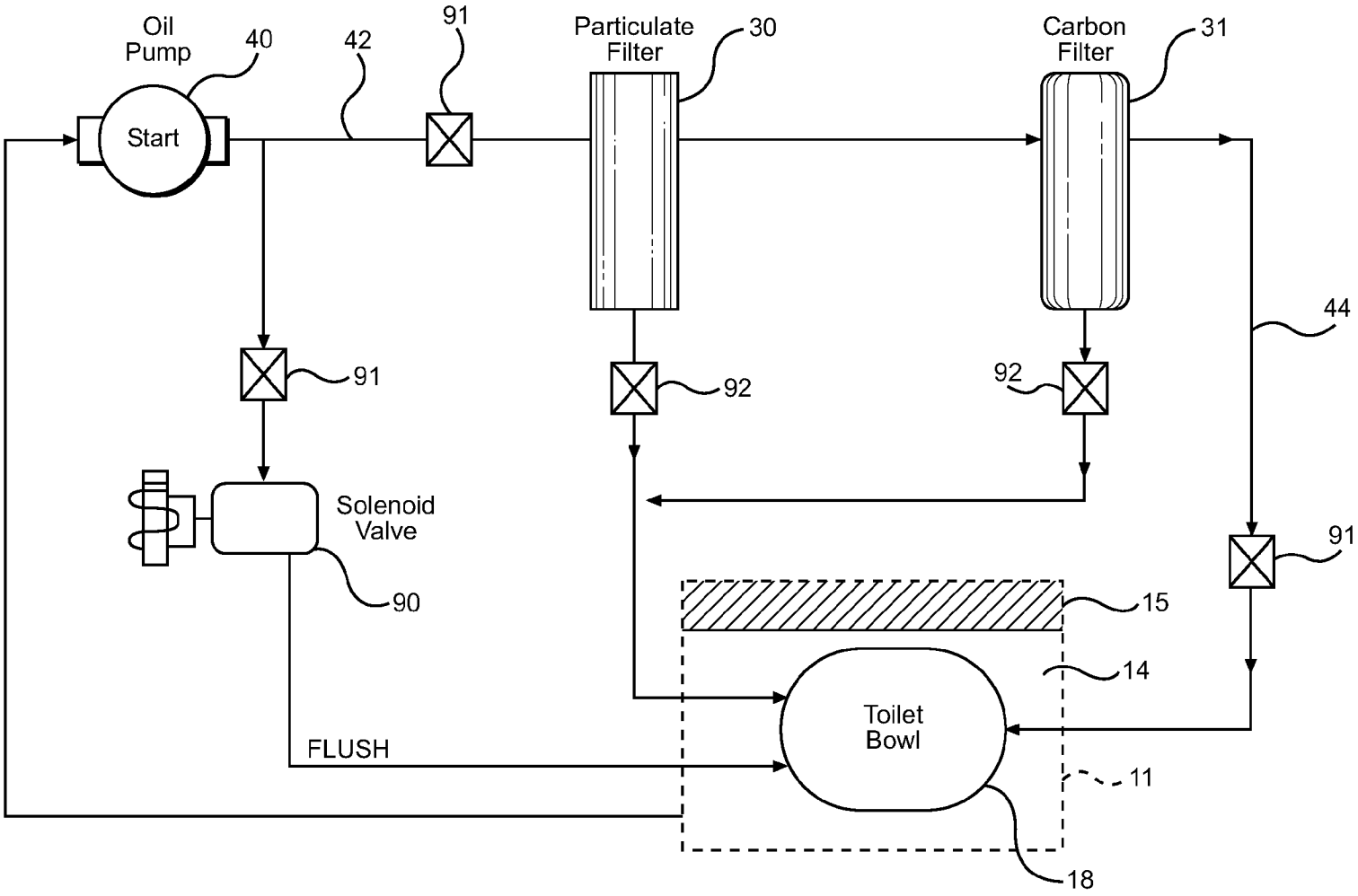

FIG. 6*a* shows a system diagram of the present invention, wherein a single pump is utilized for both oil circulation and for flushing the toilet bowl.

Figure 6B:
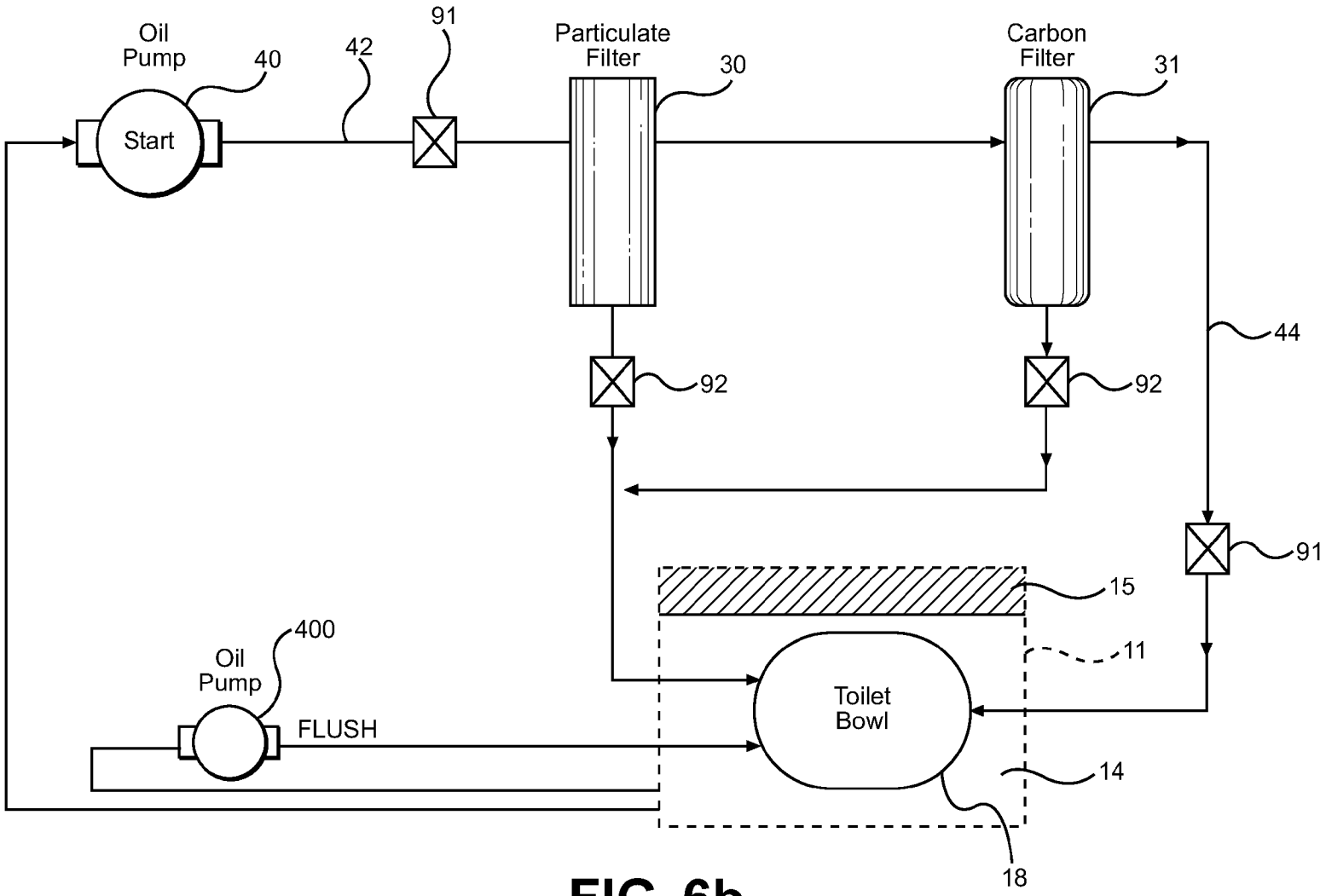

FIG. 6*b* shows a second system diagram of the present invention, wherein a second pump is deployed that is dedicated to flushing operations.

DETAILED DESCRIPTION OF THE INVENTION

Reference is made herein to the attached drawings. Like reference numerals are used throughout the drawings to depict like or similar elements of the self-contained oil flush toilet system. For the purposes of presenting a brief and clear description of the present invention, the preferred embodiment will be discussed as used for utilizing oil as a flush medium in a stand-along toilet structure requiring no sewer line connections, wherein wastewater is pretreated and can be removed for further processing on a given interval. The device requires no water or sewage line connections, and can work in rural areas, in high rise buildings, or in other locations where such infrastructure is not readily available. The figures are intended for representative purposes only and should not be considered to be limiting in any respect.

Figure 1:
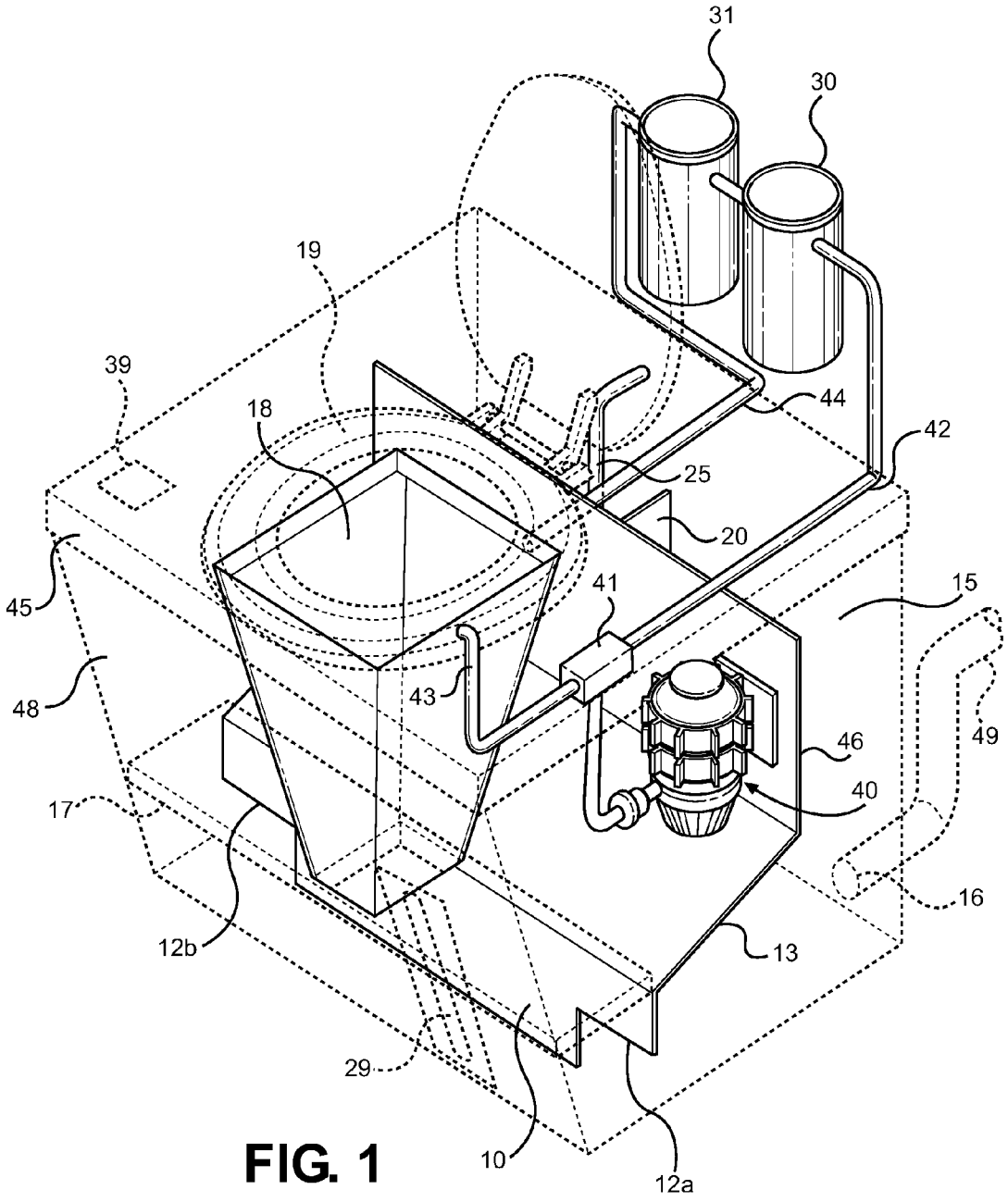
FIG. 1 shows an overhead perspective view of the present invention.

Referring now to FIG. 1, there is shown an overhead perspective view of the present invention. The device comprises an enclosure 11 having upstanding sidewalls forming a largely rectangular structure. The enclosure interior volume is secured closed by way of a removable top closure 45 that shrouds the internal components of the unit while in operation. A toilet seat 19 and toilet lid are positioned therealong above a toilet opening that allows access to the underlying toilet bowl 18. The top closure 45 may be lifted and removed during periods of maintenance or when inspecting the enclosure interior. The enclosure is one that accepts human waste therein through the toilet bowl 18 from either a standing or seated user, wherein the waste is funneled through a toilet bowl 18 and into the interior of the device for aerobic digestion and preprocessing for subsequent removal. From the exterior, the device is adapted to appear as if it were a normal commode or toilet unit, however the interior components eliminate the need for traditional water flush medium or sewage connection for processing of waste material.

The flush medium is a non-aqueous mineral oil with a specific gravity less than water, wherein urine, waste, and other excreta are rapidly consumed within the oil and sink below its surface. The walls of the toilet bowl 18 are coated with a continual stream of oil that returns 44 from a filtration process, whereby the stream in the toilet bowl prevents waste from sticking thereto. Shortened intervals of higher oil flow into the toilet bowl 18 are provided to flush the received waste from a user. Several embodiments are contemplated for accomplishing the flushing process, and include a dedicated flush pump to pump a high volume burst of oil into the toilet bowl, a baffled oil pan around the toilet bowl upper that relies on user weight close the baffle and accumulate a large volume of oil to be released when the user gets up, or finally a valve 41 that transitions the oil circulation pump 40 into a momentary flush pump. These embodiments will be discussed below in due course.

Within the interior of the enclosure 11 is a divider wall having a lower portion 10, an angled middle portion 13 and an upstanding upper portion 46. The divider separates the enclosure into a forward section 48 and a rear section 15. The forward section 48 includes a volume of oil flush medium and an oil circulation pump 40 submerged within the volume of oil. The forward section 48 also includes the flush medium/waste interface 17 that defines the separation between the flush medium and the received and in-process waste. The divided enclosure therefore operates as a waste and oil separating tank and waste preprocessing system. The oil and wastewater interface is located at the intersection between the angled middle portion 13 and the lower portion 10 of the divider wall, and is determined based on the relative levels oil flush medium utilized and the rear waste outlet port 16 along the rear of the enclosure. Along this interface is a coarse filter that readily allows the oil flush medium from the toilet bowl 18 to percolate therethrough, while blocking solid debris from floating into the upper portion of the enclosure forward section 48 (and thus comingle with the oil therein). This filter may comprise a synthetic or natural filter spanning the entire flush medium and wastewater interface 17.

Within the two peripheral sides of the divider lower portion 10 is a first 12*a* and second 12*b* cut-out aperture that allows the wastewater to flow therethrough. Based on the circulating action of the system, the wastewater naturally flows into the second cut-out aperture 12*b* and into the rear section 15 of the enclosure for aeration and subsequent circulation back into the forward portion of the enclosure by way of the first cut-out aperture 12*a*. An aerator tube 25 provides a means to aerate the wastewater and drive it over a dam wall 20 along the rear portion 15 of the enclosure, whereafter it naturally circulates through the first opening 12*a* and towards the second opening 12*b*. This continual motion of the wastewater and aeration (described in FIGS. 2-3) causes a continual biodegradation of the waste, whereby the waste is preprocessed before being removed to a treatment or disposal unit outside of the enclosure. As more waste is received, this rear section 15 of the enclosure 11 gradually fills until the waste.

A rear outlet port 16 is provided along the rear walls of the rear section 15 to remove solid, heavy waste from the base of the wastewater side through a waste conduit 49. The waste conduit 49 is positioned above the outlet port 16 to define the level of waste maintained within the rear section 15 of the enclosure 11, whereby its height is the same at which the height of the waste will be maintained within the enclosure. As the level rises, the waste is forced into the outlet 16 and through the conduit 49. The rear outlet 16 is the waste exit point in which the preprocessed waste is gathered into another enclosure or drawn into a biological incinerator, digester/evaporator, or similar final processing or storage means. The conduit 49 may be mounted externally or internally within the enclosure as desired, wherein the outlet port 16 may be positioned within the interior of the enclosure and waste travels out of the enclosure by way of the conduit 49. If internal, there is no penetration through the enclosure below the wastewater line and thus no risk of spillage therefrom.

To maintain the quality of the oil flush medium during the life of the unit, it must be continually cleaned and filtered to prevent it from breaking down or reacting with the wastewater (i.e. maintain its immiscibility therewith). To accomplish this, electrical power drives the oil circulation pump 40, which draws oil from the forward section 48 of the enclosure 11 into an oil line 42, wherein the oil passes first through a particulate filter 30 and then a carbon filter 31 before entering a return line 44 to be placed into an oil pan along the top closure 45. The filters remove surface active agents that prevent the oil from building up contaminants that would otherwise reduce its water immiscible properties. Further provided along the upper portion of the enclosure is an access door 39 along the oil side of the device, wherein chlorine tablets may be placed into the oil within the forward section 48 of the enclosure. The chlorine tablet mixes with the oil and creates a biocide to further maintain the oil operating properties. Oil from the filters 30, 31 enters back into the enclosure through a return line 44 and into an oil pan (not shown) or directly into the toilet bowl 18, whereafter the cleaned oil is deposited into the enclosure interior. The interface between the oil and wastewater can be visualized from the front of the unit 11 through a viewing window 29, which allows servicemen and technicians to inspect the quality of the oil/waste separation within the unit to the know exactly where the interface is positioned relative to the base of the unit.

Figure 2:
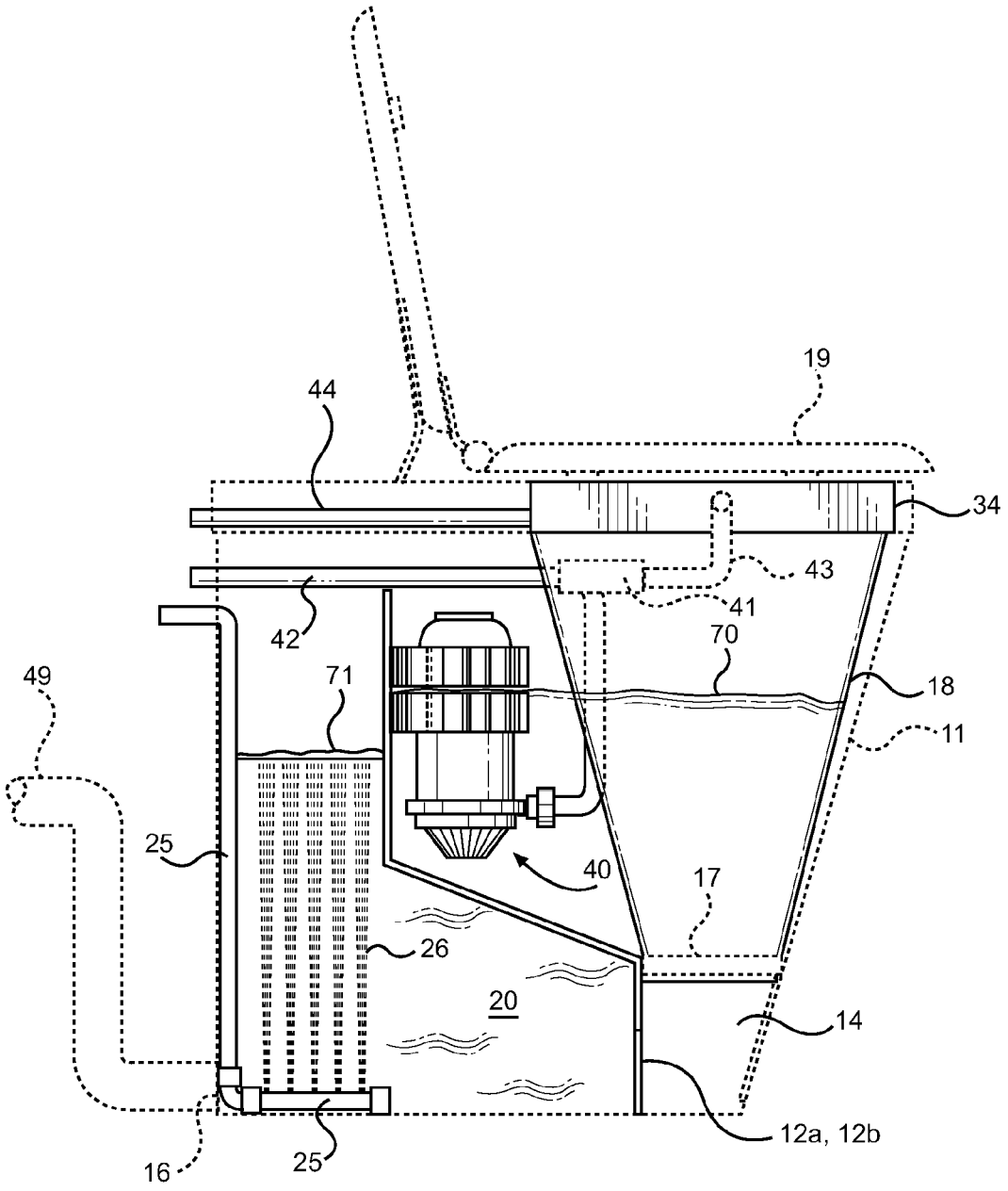
FIG. 2 shows a side view of the present invention.
Figure 3:
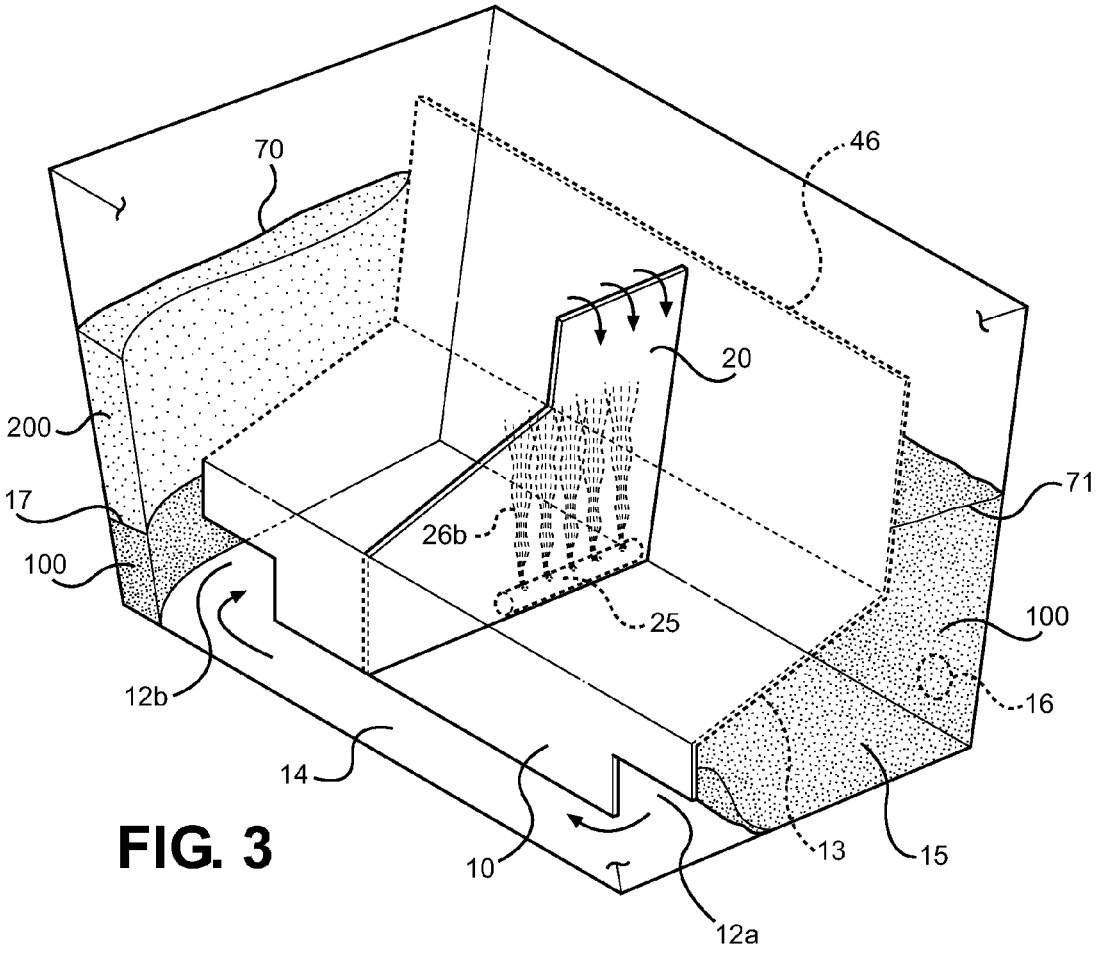
FIG. 3 shows a cut-away view of the present invention and the relative heights of, partitioning between, and flow of the oil and wastewater.

Referring now to FIGS. 2 and 3, there are shown views of the enclosure interior that highlight the positioning of the oil and wastewater interface 17 and the relative heights of both the oil 200 and wastewater 100 within the different sections of the enclosure 11. As shown, the oil circulation pump 40 is submerged within the oil 200 in the forward section, wherein the oil level 70 is above the pump intake. The oil/wastewater interface 17 is also shown along the base of the toilet bowl 18. The wastewater 100 enters the second opening 12*b* in the divider wall and is aerated by the aerator tube 25, which is a pressurized air line having a plurality of apertures therealong the send a stream of air bubbles 26 through the waste along the rear dam wall 20. The air initiates the digestion of the waste and percolates the waste over the dam wall 20. The rear waste outlet port 16 and waste conduit 49 level maintains the waste level 71 along the rear of the enclosure and allows the preprocessed and digested waste to exit the enclosure as the level of waste reaches the conduit 49 position.

In the embodiment of FIG. 2, the oil circulation pump is also utilized as a momentary flush pump, wherein oil is diverted by way of a solenoid valve 41 into a flush tube 43 and into the toilet bowl 18 when a user requests a flush of the toilet bowl 18. This is but one embodiment of the flush system.

The flush fluid pump 40 pumps the flush fluid 200 on a continuous or intermittent basis through the particulate filter and the carbon filter thereby maintaining the flush fluid in a clean and immiscible state with water. The fluid flows through the filters and back into a collection pan 34 around the toilet or directly into the toilet bowl 18. The fluid flowing into the pan is directed to flow down the toilet bowl to maintain a coating of mineral oil on the surface of the toilet bowl 18 which aids in keeping the toilet bowl free of sticking waste. In another embodiment of the flush mechanism, a baffled toilet seat device is utilized to create a dammed volume of oil that is initiated when the user sits on the toilet seat 19 and releases when the user gets up from sitting on the seat 19. When a user of the toilet sits on the seat 19, his or her weight forces a baffle to seal against the bottom of pan 34 causing fluid to stop flowing down the toilet bowl 18, thereby causing a collection of flush fluid within the pan 34. The baffle is held in the up position by springs which return the baffle to the up or flow position when the user lifts his weight from the toilet seat. The collected fluid is released beneath the baffle and causes a rush of fluid down the toilet bowl 18 forcing the waste out of the toilet bowl 18 and into the waste stream located at the lower level of cavity 14. The collection of the fluid in the pan located directly below the toilet seat is controlled by an overflow device which allows the user to sit on the seat for as long as desired without concern for collecting too much flush fluid.

As the waste increment builds in the enclosure 11, the chamber level rises in both the waste 100 and the oil 200 side. The outlet 16 for the waste to be discharged to a disposal means is located in the waste side to drain off excess fluid. This air stream from the aerator 25 promotes a vigorous boiling of the waste, breaking up the feces, toilet paper and other organic objects that can be biodegraded, and causes the fluid to flow over the top of the dam 20 to the other side of the dam, thereby creating a circular flow of waste through the unit. This circulation therefore transports the human waste 100 from under the toilet bowl 18 and through the second opening 12*b* and into the vigorously bubbling air stream 26 where the waste is broken up and oxygen is added to the waste stream to promote aerobic digestion. Waste is repeatedly circulated until through a combination of biodegradation and agitation it is reduced to a waste slurry that will pass out to a final treatment or collection source through the rear outlet 16. The air used to aerate the waste is removed from the enclosure 11 by the use of a vent blower that removes an excess of air from the toilet room, which causes the removal of any odors which may be inherent in the process of agitating and biodegrading the waste products.

Figure 4:
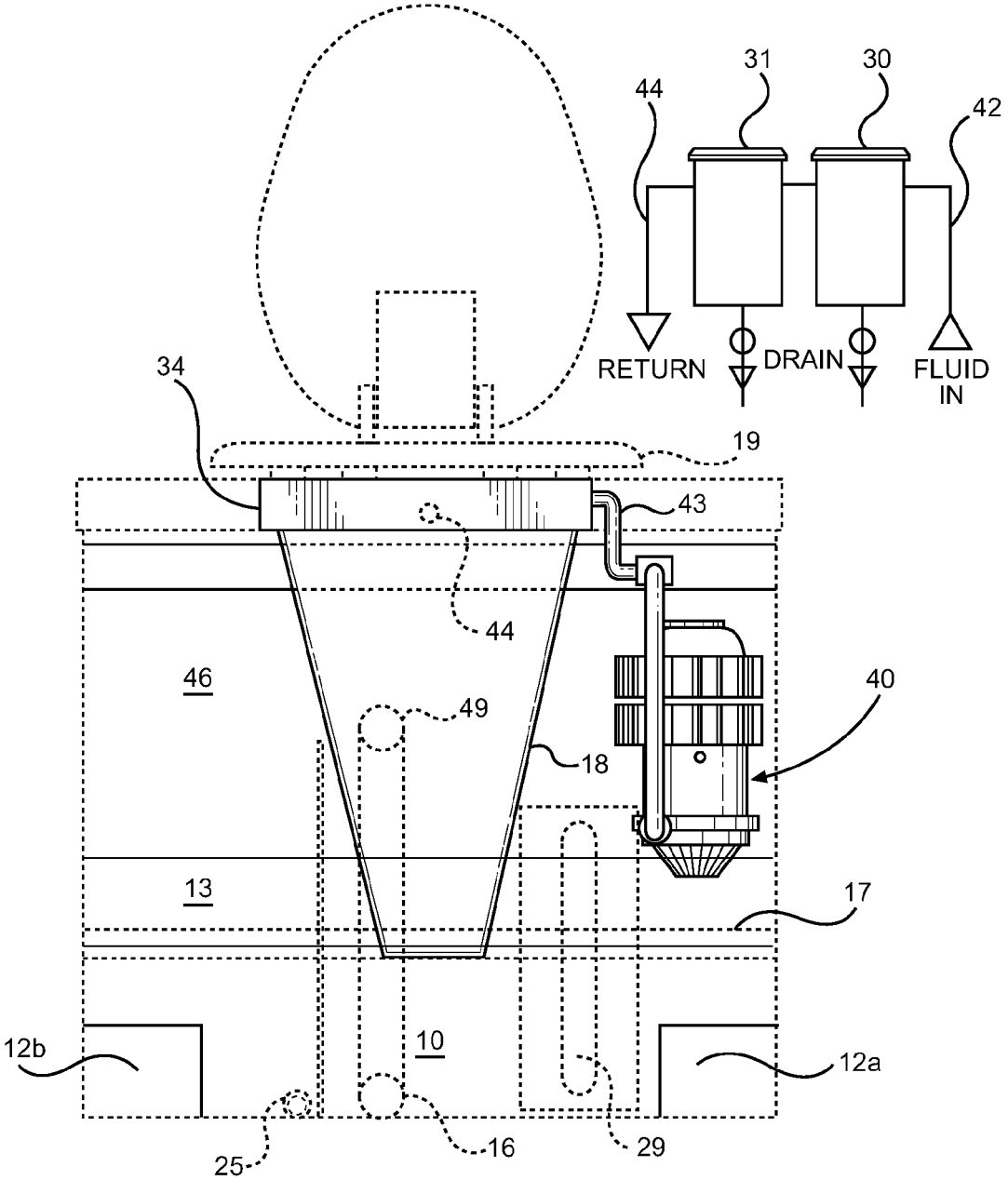
FIG. 4 shows a front view of the present invention.
Figure 5:
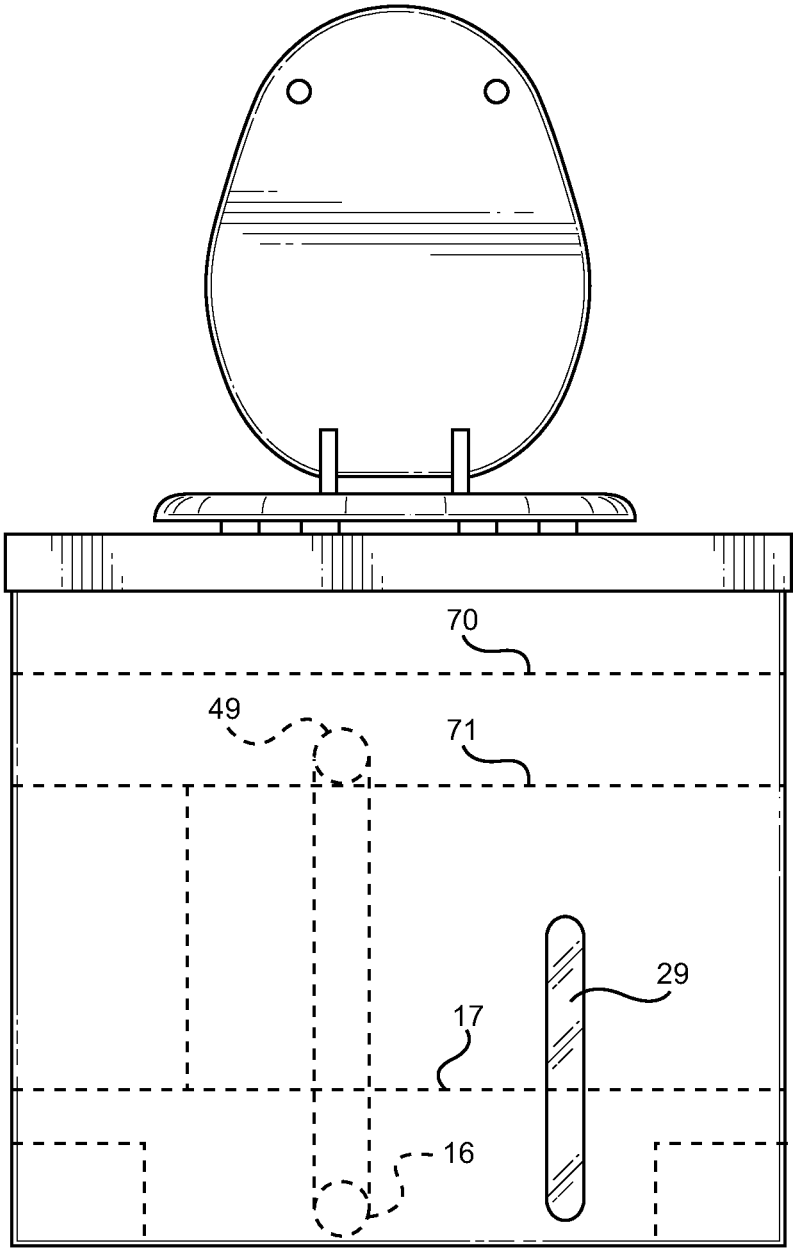
FIG. 5 shows a front view highlighting the relative heights of the oil and wastewater.

Referring now to FIGS. 4 and 5, there are shown two frontal views of the present toilet unit, along with the relative fluid levels and interfaces therebetween while in operation. During operation, the waste is continually in motion and is being circulated and eventually passed through the rear outlet 16. The relative height of the oil and waste, and their interface remains static if the oil is being cleaned and the unit is functioning properly. In FIG. 5, the waste level 71 is shown, which is regulated by the height of the waste conduit height connected to the rear outlet 16. The oil level 70 is also maintained along the forward section of the enclosure, while the oil and waste interface 17 is maintained along the forward section below the oil. The forward viewing window 29 provides a means to monitor this interface 17 during operation.

Only waste is located on rear section of the enclosure while the oil flush fluid is located in the forward section. The waste is located at the lower level, where the oil is lighter than the waste and the two mediums are immiscible with one another. The flush fluid pump 40 is submersed in the oil and pumps the flush fluid through the particulate filter 30 and the carbon filter 31 through the oil line 42 and back into the oil pan through the return line 44, thereby maintaining the flush fluid in a clean and immiscible state with water. This cleaned oil which exits the filters flows down the surface of the toilet bowl to continuously clean and wet the bowl surface which reduces the opportunity of feces or other water based substances to stick to the toilet bowl.

An air pump is required to provide aeration to the waste through the aerator tube 25. This pump can be located near to the container or in another room. Should a low-pressure compressed air source be available it may be used. The air that escapes into the unit is removed from the room with a low pressure vent blower which not only removes the airlift pump exhaust but creates a low pressure inside the container and removes the toilet smells from the room. This blower will exhaust to the outside or to an existing vent pipe or through a filter that will absorb odors.

An electrical switch panel containing on/off switches and fuses is also to be located nearby the toilet unit to provide power to the fluid pump 40, the vent blower and the air pump. There are no electrical control circuitry or control devices necessary to operate the system, making the system simple for maintenance and for continued operation. The fluid maintenance system (i.e. the filtering) is provided to maintain the flush fluid in a clean sanitary condition and to remove surface active agents from the oil. The fluid pump is submersed in the mineral oil with an on off switch located on the electrical panel. Flush fluid is pumped through the filter system at all times or intermittently if desired.

Referring finally to FIGS. 6*a* and 6*b*, there are shown two embodiments of the oil circulation system, whereby one embodiment (FIG. 6*a*) contemplates a single oil pump 40 for oil circulation and for toilet bowl 18 flushing. In this embodiment, the pump 40 operates normally by circulating the flush fluid through an oil line 42 to a particulate 30 and carbon 31 filter, and then through the oil return line 44 and into the toilet bowl 18. The oil then enters the forward portion 14 of the enclosure while waste is consumed by the oil and passed through the enclosure rear section 15 for processing. A solenoid valve 90 is provided to operate the motor as a flush pump, wherein the oil is diverted directly into the toilet bowl 18 for flushing waste from a user therefrom for a shortened period of time. Several hand valves 91 are provided along the lines to regulate or adjust the pressure in the lines, while water developed as a byproduct from the filters is drained through drain valves 92 and deposited into the toilet bowl. In a second embodiment, and as shown in FIG. 6*b*, a dedicated and secondary flush pump 400 is deployed that is user activated. The flush pump 400 only operates to provide a burst of oil from the forward section 14 of the enclosure into the toilet bowl 18 to draw waste therefrom. All other portions of the oil circulation system remain largely the same as in the first embodiment.

Overall, the present invention provides a system and apparatus that can replace a conventional water-flush toilet with one that utilizes an oil flush medium and an internal processing means that does not require external sewage lines to vacate waste as it is deposited. The device comprises a self-contained toilet that does not require an external sewerage connection, utilizing an oil pump, a biological aerating process and an enclosure that preprocesses waste for subsequent removal. The removed waste can be taken to a waste processing means, such as a biological incinerator, digestor/evaporator, storage tank, or similar processing means external to the disclosed unit. A user can install the present toilet unit where there is no central wastewater treatment connection line, or where there is no sewage collection system already in existence. An office, industrial facility, apartment complex, a seagoing vessel, or remote, rural or developing location can utilize the device for collecting human waste.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sewage treatment system for separating and pretreating waste, comprising:

a separating tank for receiving toilet waste;

said separating tank having a non-aqueous liquid flush medium having a specific gravity less than water;

said separating tank further comprising a toilet bowl, a flush medium circulation pump, a flush medium and waste divider wall, and a waste aerator means;

said divider wall for dividing said separating tank into a flush medium side and a waste side, wherein waste is received through said toilet bowl on said flush medium side, whereafter said waste sinks below said flush medium and is circulated through apertures in said divider wall to said waste side;

said waste aerator means located within said waste side for aerating said waste;

wherein said waste aerator means drives said waste over a dam wall disposed within said waste side;

said flush medium circulation pump submerged within said flush medium within said flush medium side for circulating said flush medium through at least one filter to maintain said flush medium and depositing said flush medium into said toilet bowl thereafter;

a waste outlet port along said waste side to allow waste to exit said separating tank for further processing or collection.

2. The device of claim 1, further comprising a flush means for cleaning said toilet bowl with a volume said flush medium.

3. The device of claim 2, wherein said flush means further comprises a secondary flush pump immersed in said flush medium for pumping a volume of flush medium into said toilet bowl.

4. The device of claim 2, wherein said flush means further comprises a solenoid switch for diverting said flush medium from said flush medium circulation pump into said toilet bowl.

5. The device of claim 1, wherein said aerator means further comprises an aerator tube, an air pump, and apertures in said aerator tube to permit air bubbles to enter said waste side.

6. The device of claim 1, wherein said at least one flush medium filter further comprises a particulate filter and carbon filter.

7. The device of claim 1, wherein said waste outlet further connects to a waste conduit that is positioned at a height such that said waste in said waste side is maintained at a desired level.

8. The device of claim 7, wherein said waste conduit is positioned at the level of waste in said waste side.

9. A sewage treatment system for separating and pretreating waste, comprising:

a separating tank for receiving toilet waste;

said separating tank having a non-aqueous liquid flush medium having a specific gravity less than water;

said separating tank further comprising a toilet bowl, a flush medium circulation pump, a flush medium and waste divider wall, and a waste aerator means;

said divider wall for dividing said separating tank into a flush medium side and a waste side, wherein waste is received through said toilet bowl on said flush medium side, whereafter said waste sinks below said flush medium and is circulated through apertures in said divider wall to said waste side;

said waste aerator means located within said waste side for aerating said waste;

wherein said waste aerator means drives said waste over a dam wall disposed within said waste side;

said flush medium circulation pump submerged within said flush medium within said flush medium side for circulating said flush medium through at least one filter to maintain said flush medium and depositing said flush medium into said toilet bowl thereafter;

a waste outlet port along said waste side to allow waste to exit said separating tank for further processing or collection;

wherein said sewage treatment system is a self-contained unit that is adapted to function without external sewer lines or flush fluid provider lines connected thereto.

10. The device of claim 9, further comprising a flush means for cleaning said toilet bowl with a volume said flush medium.

11. The device of claim 10, wherein said flush means further comprises a secondary flush pump immersed in said flush medium for pumping a volume of flush medium into said toilet bowl.

12. The device of claim 10, wherein said flush means further comprises a solenoid switch for diverting said flush medium from said flush medium circulation pump into said toilet bowl.

13. The device of claim 9, wherein said aerator means further comprises an aerator tube, an air pump, and apertures in said aerator tube to permit air bubbles to enter said waste side.

14. The device of claim 9, wherein said at least one flush medium filter further comprises a particulate filter and carbon filter.

15. The device of claim 9, wherein said waste outlet further connects to a waste conduit that is positioned at a height such that said waste in said waste side is maintained at a desired level.

16. The device of claim 15, wherein said waste conduit is positioned at the level of waste in said waste side.

* * * * *